US011885188B2

(12) United States Patent
Ruttley et al.

(10) Patent No.: US 11,885,188 B2
(45) Date of Patent: Jan. 30, 2024

(54) SECTION MILL

(71) Applicant: Dynasty Energy Services, LLC, Lafayette, LA (US)

(72) Inventors: David J. Ruttley, Alexandria, LA (US); Gerald J. Cronley, Gretna, LA (US)

( * ) Notice: Subject to any disclaimer, the term of this patent is extended or adjusted under 35 U.S.C. 154(b) by 0 days.

(21) Appl. No.: 18/058,178

(22) Filed: Nov. 22, 2022

(65) Prior Publication Data

US 2023/0167702 A1 Jun. 1, 2023

Related U.S. Application Data

(60) Provisional application No. 63/284,441, filed on Nov. 30, 2021.

(51) Int. Cl.
*E21B 29/00* (2006.01)

(52) U.S. Cl.
CPC ..... *E21B 29/005* (2013.01)

(58) Field of Classification Search
CPC ..... E21B 29/00; E21B 29/002; E21B 29/005; E21B 29/08
See application file for complete search history.

(56) References Cited

U.S. PATENT DOCUMENTS 1,789,995 A * 1/1931 Barkis ..... E21B 43/112 175/269
2,899,000 A 8/1959 Medders et al.
4,282,941 A * 8/1981 Perkin ..... E21B 10/345 175/269
5,373,900 A * 12/1994 Lynde ..... E21B 29/002 166/55.6
5,385,205 A * 1/1995 Hailey ..... E21B 10/322 175/267
7,063,155 B2 6/2006 Ruttley
9,695,660 B2 7/2017 Ruttley
9,938,781 B2 * 4/2018 Bansal ..... E21B 29/002
10,012,048 B2 7/2018 Segura et al.
10,161,209 B1 12/2018 Hutchinson
10,202,814 B2 2/2019 Fuller et al.
10,240,418 B2 3/2019 Ruttley
10,344,548 B2 7/2019 Ruttley et al.
10,526,849 B2 1/2020 Lin et al.
10,605,025 B2 3/2020 Ruttley
10,815,745 B2 10/2020 Dewey et al.
10,989,005 B2 4/2021 Ruttley
11,248,430 B2 2/2022 Ruttley et al.
11,274,514 B2 3/2022 Segura et al.
11,441,378 B2 9/2022 Ruttley
2011/0220357 A1 9/2011 Segura et al.
(Continued)

*Primary Examiner* — David Carroll

(57) ABSTRACT

A section mill for milling wellbore tubulars has a tubular mill body, a pivotally mounted mill carrier having a beveled interior profile and a cutter blade on its exterior profile, and a translatable piston having an elongated driveshaft with a radially extending nose cone with a compression spring positioned around the elongated driveshaft. A hook on the elongated driveshaft configured to mate with a corresponding hook catch in the mill carriers maintains the mill carrier in a retracted position. The nose cone of the translatable piston moves upward and downward along the beveled interior profile of the mill carrier in response to fluid pressure. Rotation of the mill body rotates the attached mill carrier and cutter blade for milling.

18 Claims, 11 Drawing Sheets

(56) References Cited

U.S. PATENT DOCUMENTS

| | | | | |
|---|---|---|---|---|
| 2013/0213641 | A1 | 8/2013 | Layden et al. | |
| 2015/0354320 | A1 | 12/2015 | Mahajan et al. | |
| 2016/0130899 | A1* | 5/2016 | Cronley | E21B 29/005 166/55.8 |
| 2018/0100373 | A1* | 4/2018 | Krüger | E21B 47/005 |
| 2020/0217170 | A1* | 7/2020 | Krüger | E21B 33/1277 |
| 2022/0025727 | A1 | 1/2022 | Ruttley et al. | |

* cited by examiner

SECTION MILL

PRIORITY

This application claims priority to U.S. Provisional Application Ser. No. 63/284,441 entitled "Section Mill" filed Nov. 30, 2021, the entire content of which is incorporated by reference.

FIELD OF THE INVENTION

This invention relates to the field of sub-surface wellbore tools and equipment and, more particularly, to a section mill for milling or cutting through a wellbore tubular or casing disposed in a wellbore.

BACKGROUND OF THE INVENTION

Oil and gas wellbores are typically lined with a string or strings of wellbore tubulars such as a string of casing pipe. Section mills are used to mill or cut through a section of these wellbore tubulars during various phases of the drilling and production process or during remediation of the wellbore post the production life of the well. Section mills are typically attached to a tool carrier pipestring, such as a drill pipe string or a coiled tubing string, and then placed at a desired location within the wellbore tubular to be milled.

Section mills typically employ at least one retractable rotatable cutter carrier that extends radially outward from the section mill. The cutter carriers typically have attached hardened cutters that engage the wall of the wellbore tubular to be milled. Circulating wellbore fluid is utilized to rotate the section mill and associated cutters to facilitate milling. The cuttings from the milling operation are then circulated out of the wellbore by means of circulating wellbore fluid.

The use of many conventional section mills cause problems that result in unreliable and inconsistent milling. These problems include wobbling and vibration of the rotating cutter carriers, incomplete extension and retraction of the extendable cutter carriers, the inability to fully engage the cutters with wellbore tubular being milled, inadequate radial force on the cutters, the inability to mill both upwards and downward, excessive wear on the cutters and the cutter drive system, removal and disposal of mill swarf, and the U-tube effect on the drilling fluids circulating in the wellbore. These problems result in reduced milling efficiency, increased milling time, increased wear and tear on the section mill, and increased cost of the milling operations.

Consequently, there is a need for a section mill that will reduce or eliminate such problems and thus reduce the time and cost associated with the milling process and ultimately the cost of oil and gas production and associated well remediation.

SUMMARY OF THE INVENTION

The proposed invention provides a section mill designed for milling or cutting through a wellbore tubular disposed in a wellbore that will help reduce or eliminate the problems associated with conventional section mills. The proposed section mill has a longitudinally extending cylindrical tubular mill body threadedly attached to a top sub which is attached to a tool carrier pipe string. The top sub has a central bore in fluid communication with a central bore within the tubular mill body and the tool carrier pipe string.

Positioned within the tubular mill body of the section mill is a translatable piston having an elongated driveshaft and at least one radially extendable and retractable mill carrier that is mounted to the tubular mill body by a carrier hinge pin. At least one cutter blade having a hardened cutter surface is fixed to the mill carrier. Multiple mill carriers with multiple cutter blades may be provided depending upon the diameter of the tubular mill body and the wellbore tubular within which the section mill is to be used.

The translatable piston moves upward (i.e., uphole) and downward (i.e., downhole) within the mill body in response to fluid pressure generated in the central bore of the top sub. The elongated driveshaft of the translatable piston has an upper portion and a lower portion. The upper portion of the elongated driveshaft is positioned around a longitudinally extending compression spring. The compression spring bears against a shoulder on the upper portion of the elongated driveshaft piston and an internal stop shoulder on the tubular mill body. The expansion of the compression spring holds the translatable piston in an upwardly biased position. The lower portion of the elongated driveshaft has a radially extending cylindrical nose cone at its downhole end, the periphery of the cylindrical nose cone is configured to engage with a radially inward angled or beveled interior ramp profile on the interior surface of the pivotally mounted mill carrier.

Translation of the translatable piston and its elongated driveshaft engages the periphery of the cylindrical nose cone with the beveled ramp profile of the pivotally mounted mill carrier. Downward translation of the translatable piston and its elongated driveshaft compresses the compression spring and moves the cylindrical nose cone downward along the beveled ramp profile on the pivotally mounted mill carrier. This downward movement of the nose cone will angularly pivot the mill carrier on the carrier hinge pin radially and longitudinally outward from the tubular mill body. This pivotal movement of the mill carrier on the carrier hinge pin moves the mill carrier radially outward from a mill window in the tubular mill body at an acute angle to position the attached cutter blade against the wellbore tubular to be milled. Upward translation of the translatable piston and its elongated driveshaft moves the nose cone upward along the beveled ramp profile on the pivotally mounted mill carrier to pivot the mill carrier on the carrier hinge pin to retract the mill carrier and the attached cutter blade radially and longitudinally inward into the mill window and the tubular mill body.

The lower portion of the elongated driveshaft may be provided with a radially projecting hook for securing the mill carrier when the section mill is moved upward and downward within the wellbore tubular. The hook on the elongated driveshaft is configured to mate with a corresponding hook catch in the mill carrier when the elongated driveshaft is in a fully upward position. Upward translation of the translatable piston and its elongated driveshaft will engage the hook with the hook catch in the mill carrier and hold the mill carrier radially inward with the cutter blade retracted into the mill body. Downward translation of the translatable piston and its elongated driveshaft will disengage the hook of the elongated driveshaft from the hook catch in the mill carrier and move the nose cone of the elongated driveshaft along the beveled ramp profile to pivot the mill carrier on the carrier hinge pin to extend the cutter blade from the mill window. Milling is conducted by rotation of the section mill by the tool carrier pipe string or by an associated downhole motor.

The section mill described herein may be constructed with a mill body and central bore of desired diameters and with multiple mill carriers each having multiple cutter blades as desired and may be configured for use with a drill pipe string, a coiled tubing string, or other suitable tool carrier pipe string. The diameter of the mill body, the number of mill carriers, and the number cutter blades provided on the section mill will, in most instances, depend upon the diameter of the wellbore tubular within which the section mill will be used. As the diameter of the section mill body is increased, the number of mill carriers and associated cutter blades may also be increased. By way of example, for a mill body diameter of 3.5 inches, it is thought that two mill carriers may be provided. For a mill body diameter of 7.875 inches, it is thought that three mill carriers may be provided.

BRIEF DESCRIPTION OF DRAWINGS

At FIG. 1 is a longitudinal side view of an embodiment of the proposed section mill.

DESCRIPTION OF THE EMBODIMENTS

Figure 1:
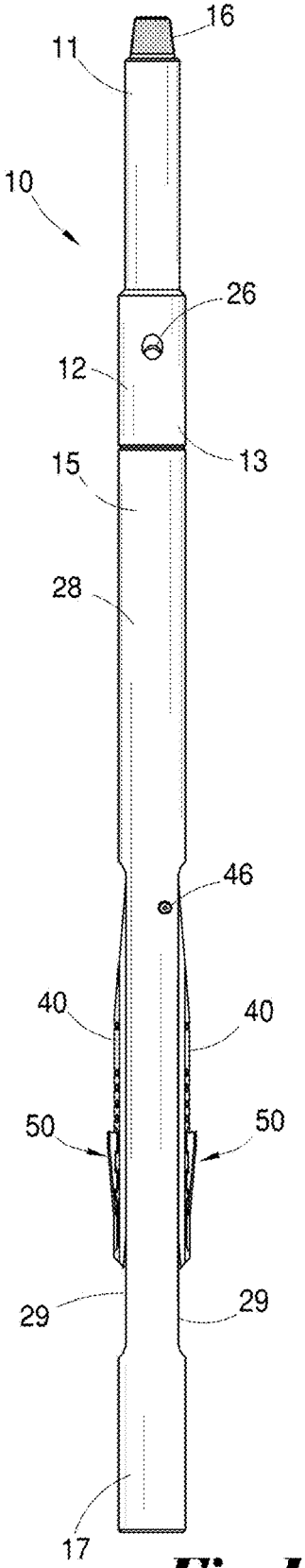
Figure 2:
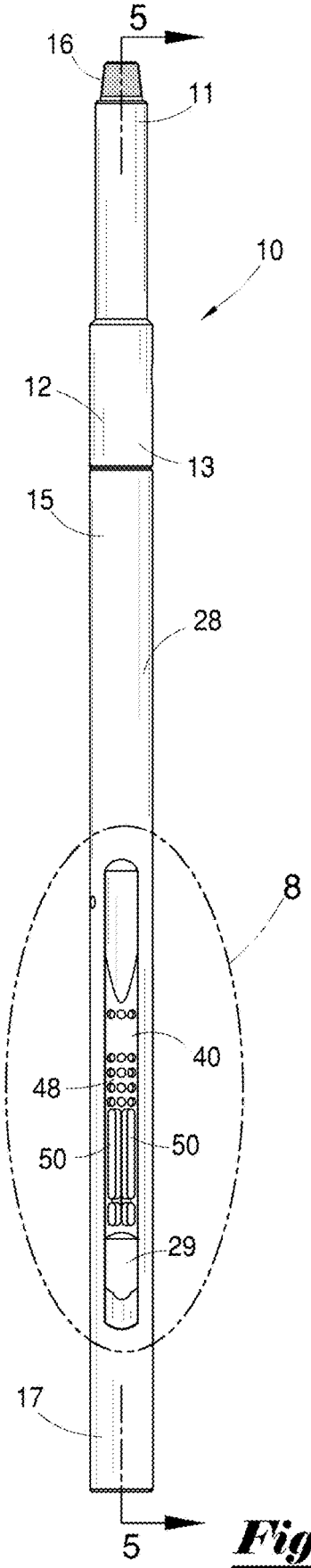
FIG. 2 is a longitudinal side view of the section mill of FIG. 1 showing the mill window and mill carrier.
Figure 3A:
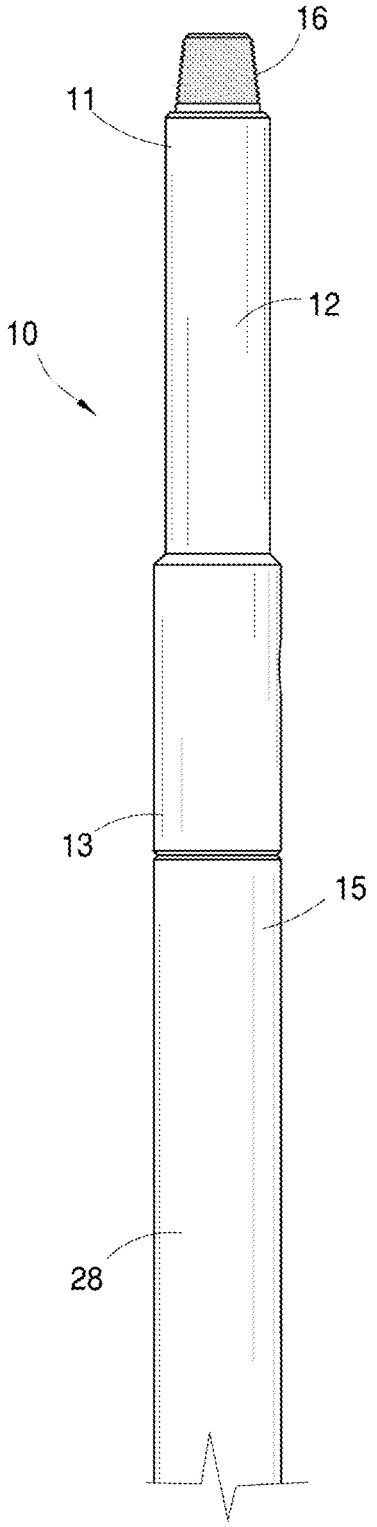
FIG. 3A in an enlarged partial longitudinal side view of the upper end of the section mill of FIG. 1 and the attached top sub.
Figure 3B:
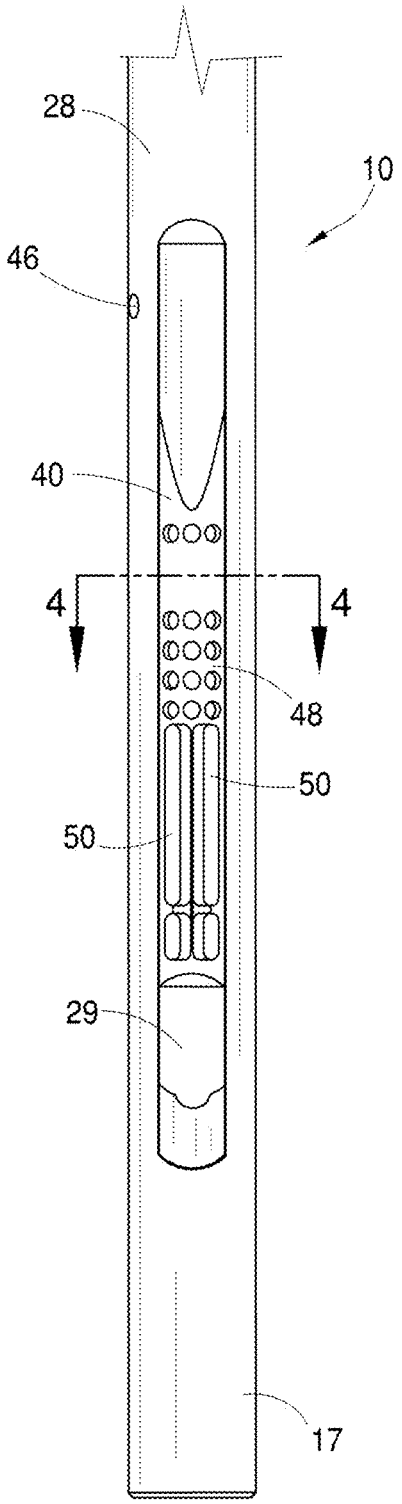
FIG. 3B is an enlarged partial longitudinal side view of the lower end of the section mill of FIG. 1 showing the mill window and mill carrier.
Figure 6:
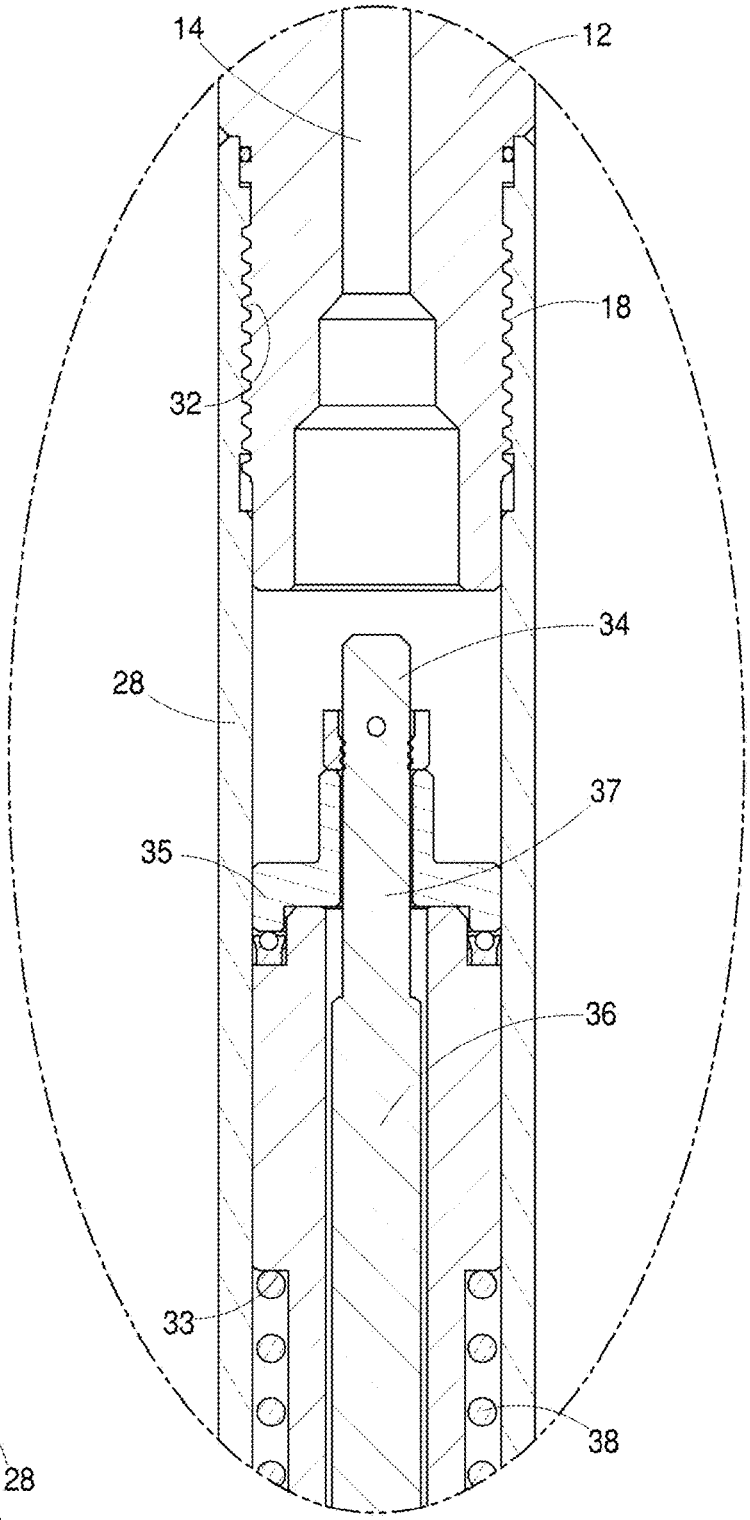
FIG. 6 is a detailed longitudinal cross-section side view of the area designed as Detail 6 shown in FIG. 5A.
Figure 4:
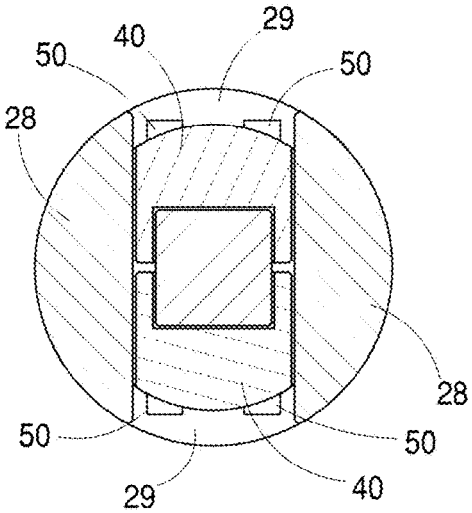
FIG. 4 is a horizontal cross-section detail view of the section mill cut along Section 4-4 of FIG. 3B.

Embodiments of a proposed section mill 10 are shown in the drawings. In the embodiment shown in FIGS. 1 through 9B, the section mill 10 has a longitudinally extending tubular mill body 28 threadedly attached to a top sub 12. The top sub has an uphole or upper end 11 and a downhole or lower end 13. The mill body has an upper end 15 and a lower end 17. The upper end 11 of the top sub 12 is threadedly attached to a carrier pipe string 100 by a threaded connection 16 that mates with a threaded connection on a tool carrier pipe string 100. The lower end 13 of the top sub 12 is threadedly attached to the uphole or upper end 15 of the mill body 28 by a threaded connection 18 that mates with a threaded connection 32 on the mill body 28.

Figure 5A:
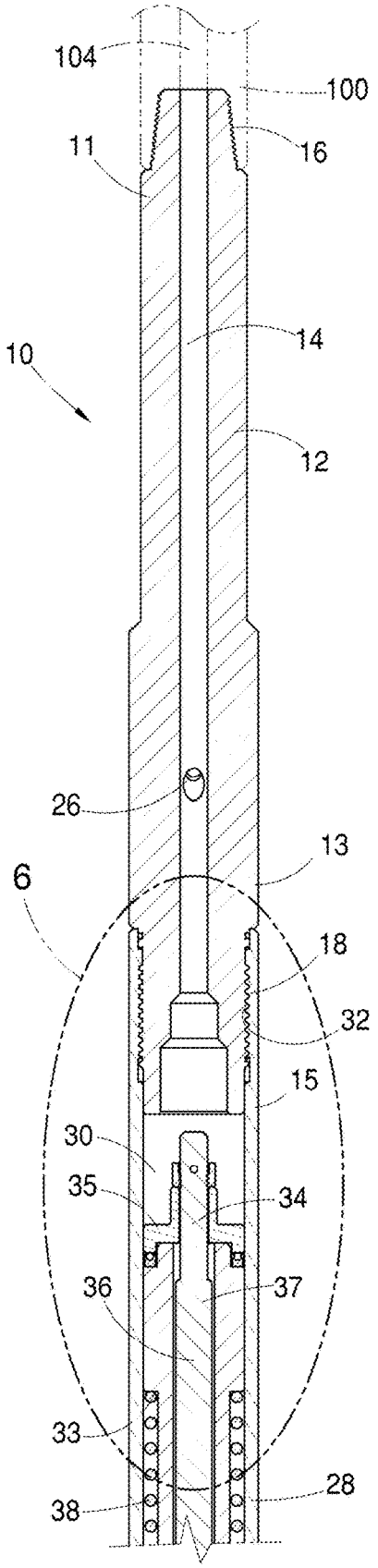
FIG. 5A is a partial longitudinal cross-section view of the upper end of the section mill of FIG. 1 cut along Section 5-5 of FIG. 2 showing the translatable piston and the attached top sub.
Figure 5B:
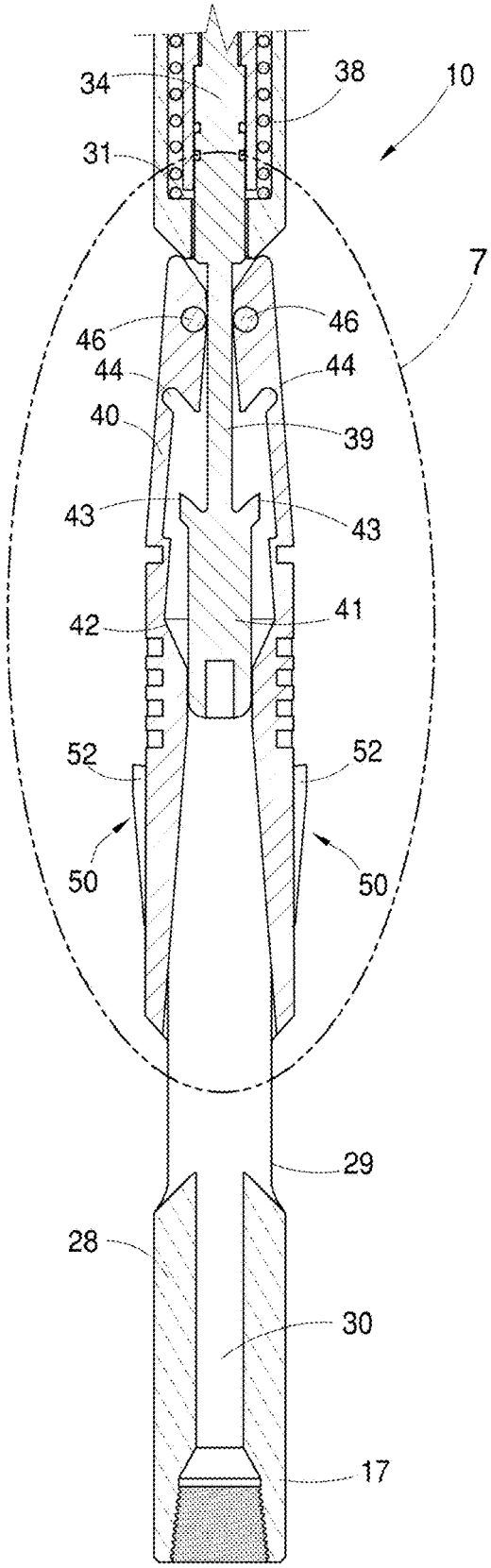
FIG. 5B is a partial longitudinal cross-section view of the lower end of section mill of FIG. 1 cut along section 5-5 of FIG. 2 showing the mill window and mill carrier.

Referring to FIGS. 5A and 5B, the top sub 12 has a central fluid bore 14 in fluid communication with a central fluid bore 104 in the tool carrier pipe string 100 and in fluid communication with a central fluid bore 30 within the tubular mill body 28. The tool carrier pipe string 100 may be a drill pipe string, a coiled tubing string, or other suitable carrier pipe string. The lower end 17 of the tubular mill body 28 may have a threaded connection for attachment of an additional pipe string below the section mill 10.

Figure 13:
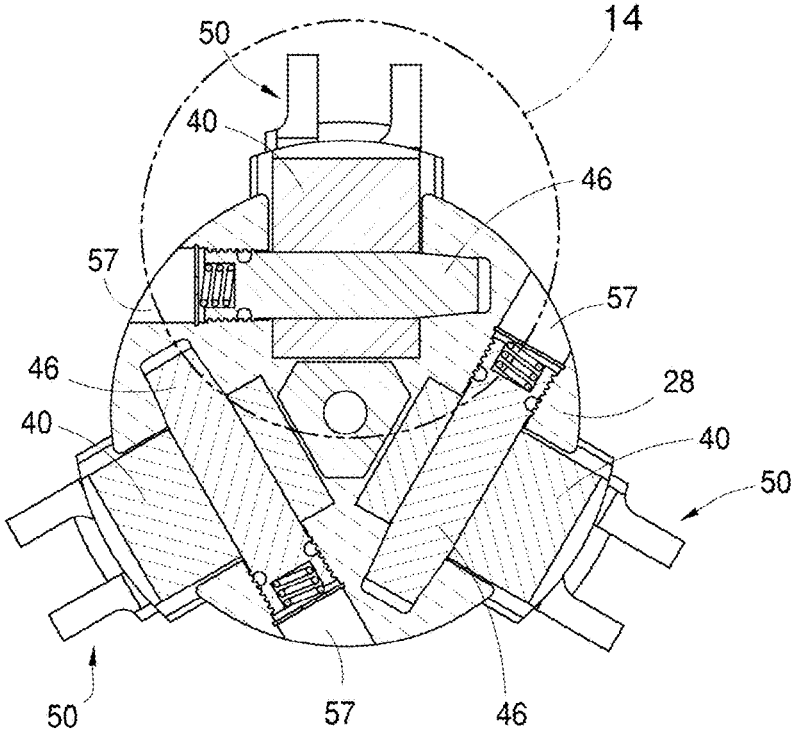
FIG. 13 is a horizontal cross-section view of the embodiment of the section mill shown in FIG. 10 cut along Section 13-13 of FIG. 10.
Figure 14:
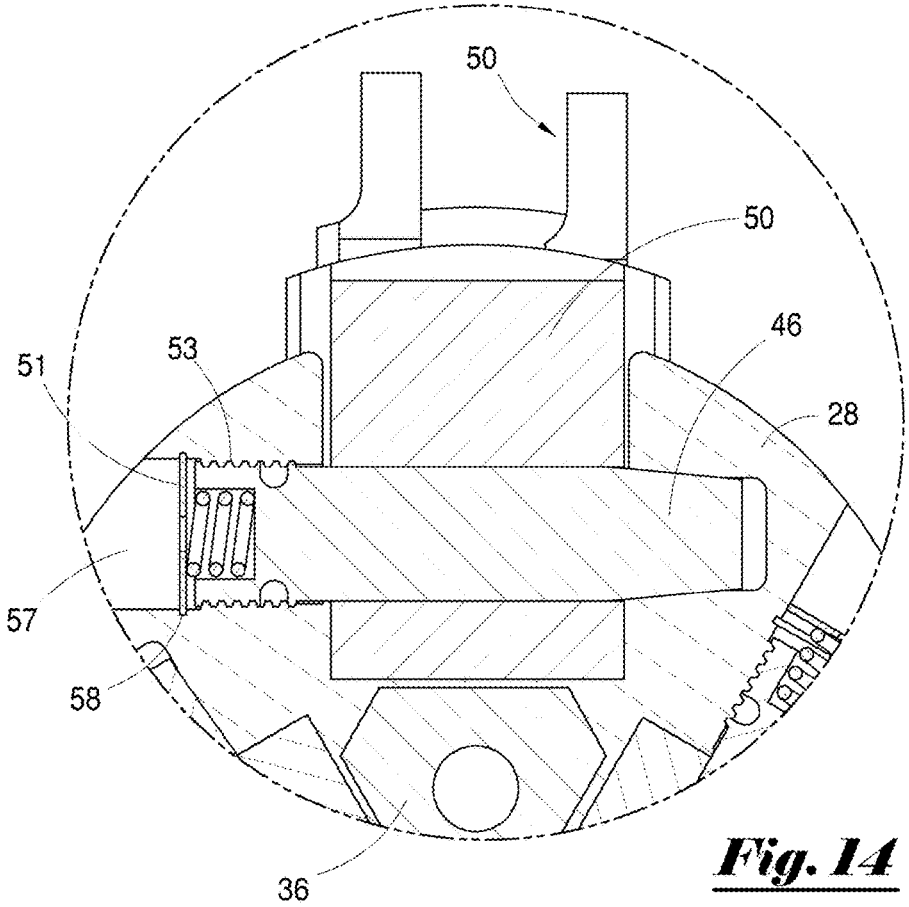
FIG. 14 is a detailed view of the area designed as Detail 14 shown in FIG. 13.

Positioned within the tubular mill body 28 is a translatable piston 34 and at least one mill carrier 40 that is pivotally mounted to the mill body 28 by a carrier hinge pin 46 that is transverse to the longitudinally extending mill body 28 such as that shown in FIG. 13 and FIG. 14. The hinge pin 46 is shown in detail in FIGS. 15-19. The interior surface of the mill carrier 40 has an inwardly beveled ramp profile 42. The exterior surface of the mill carrier 40 has at least one cutter blade 50. The translatable piston 34 has an elongated driveshaft 36 and an upper seal section 35 that translatably seals the central fluid bore 30 of the mill body 28.

The translatable piston 34 moves upward and downward within the central fluid bore 30 of the mill body 28 in response to fluid pressure generated in the central fluid bore 104 of the carrier pipe string 100 and the central fluid bore 14 of the top sub 12. The elongated driveshaft 36 of the translatable piston 34 has an upper portion 37 and a lower portion 39. A longitudinally extending compression spring 38 is positioned around the upper portion 37 of the elongated driveshaft 36. The compression spring 38 bears against a shoulder 33 on the upper portion 37 of the elongated piston driveshaft 36 and an internal stop shoulder 31 on the tubular mill body 28 to bias the translatable piston 34 with its elongated driveshaft 36 in a normally upward or uphole direction.

The lower portion 39 of the elongated driveshaft 36 has a nose cone 41 extending radially from the elongated driveshaft 36. The nose cone 41 is configured to engage with the inwardly beveled ramp profile 42 on the interior surface of the mill carrier 40 to pivot the miller carrier 40 radially inward and outward on the hinge pin 46 as the nose cone 41 moves upward and downward. It is thought that the nose cone 41 will be cylindrical in shape though any other suitable geometric configuration may be utilized.

The lower portion 39 of the elongated driveshaft 36 of the translatable piston 34 has at least one radially projecting hook 43. The hook 43 is configured to engage and mate with a corresponding hook catch 44 in the mill carrier 40. The translatable piston 34 and its elongated driveshaft 36 is normally translated upward by the compression spring 38 which forces the hook 43 to engage with its corresponding hook catch 44 in the mill carrier.

Downward translation of the translatable piston 34 and its elongated driveshaft 36 within the central fluid bore 30 of the mill body 28 from fluid pressure generated from the central fluid bore 14 of top sub 12 will translate the translatable piston 34 and its elongated driveshaft 36 downward to disengage the hook 43 from its corresponding hook catch 44 and move the nose cone 41 of the translatable piston 34 to engage with the beveled ramp profile 42 on the pivotally mounted mill carrier 40. As the nose cone 41 moves downward along the beveled ramp profile 42, the mill carrier 40 pivots on the transverse carrier hinge pin 46 to move mill carrier 40 and its attached cutter blade 50 radially and longitudinally outward at an acute angle from a mill window 29 in the tubular mill body 28 against a wellbore tubular to be milled.

The nose cone 41 bearing on the beveled ramp profile 42 of the mill carrier 40 and pivoting the mill carrier 40 radially outward on a single hinge pin 46 serves to stabilize the mill carrier 40 and attached cutter blade 50 during the milling process and thus reduces wobbling and vibration of the miller carriers. Because the mill carriers 40 are pivoted radially outward at an acute longitudinal angle with respect to the longitudinally extending mill body 28 on a single hinge pin 46, as shown in FIGS. 7, 11, 12*b*, and 13, the extension of the mill carriers 40 more reliably engages the cutter blade 50 and cutter surfaces 52 with the wellbore tubular being milled. The use of the single hinge pin 46 as a pivot point for the mill carrier 40 also reduces wear and tear on the mill carrier and allows for more efficient maintenance of section mill.

Reduction of the fluid pressure generated in the central fluid bore 14 of top sub 12 will decrease the fluid pressure on the translatable piston 34 to allow the compression spring 38 to extend and move the translatable piston 34 and its elongated driveshaft 36 upward within the central fluid bore 30 of the mill body 28 and move mill carrier 40 and its attached cutter radially inward into the mill window 29 and re-engage the hook 43 with its corresponding hook catch 44.

Figure 8:
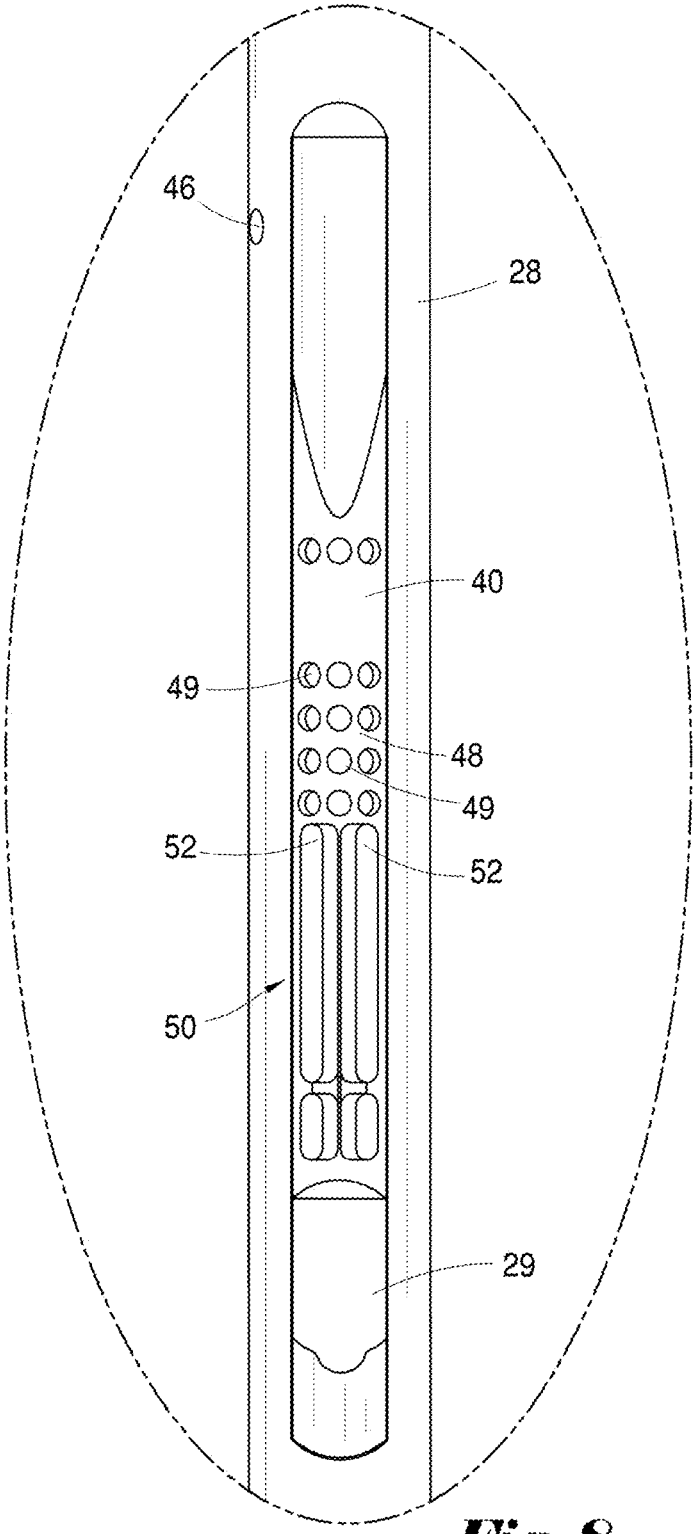
FIG. 8 is an enlarged partial longitudinal side view of the area designed as Detail 8 of FIG. 2 showing the mill window and mill carrier.

As shown in FIG. 8, the cutter blade 50 has a hardened cutter surface 52. The hardened cutting surface 52 may be a carbide surface, a surface of polycrystalline diamond, or the like to facilitate milling. The hardened cutting surface 52 may also be hardened cutter inserts comprised of carbide, polycrystalline diamond, or the like. Stabilizer pads 48 having hardened surfaces 49 may be provided on the mill carrier 40 to bear against the inner wall of a tubular segment and stabilize the mill carrier 40 during the milling process. Milling is conducted by rotation of the section mill 10 to rotate the hardened cutting surface 52 of the cutter blade 50 against a surface to be milled.

As shown in the drawings, top sub 12 is provided with ports or bores 26 in fluid communication with the central fluid bore 14 of the top sub 12. The ports 26 allow for pressure adjustments within the central fluid bore 30 of section mill 10. The ports 26 may be drilled and tapped to receive pressure adjustment devices such as jets or nozzles 27. Such pressure adjustment devices allow users to make pressure adjustments within the section mill 10 to enhance its function and facilitate removal of cuttings and mill swarf created during milling. The ports 26 may also be provided with a plunger or flapper-type float valve to mitigate the effect of U-tubing and to prevent debris from entering the tubular mill body 10 when pumping ceases or when a connection is required.

Figure 9A:
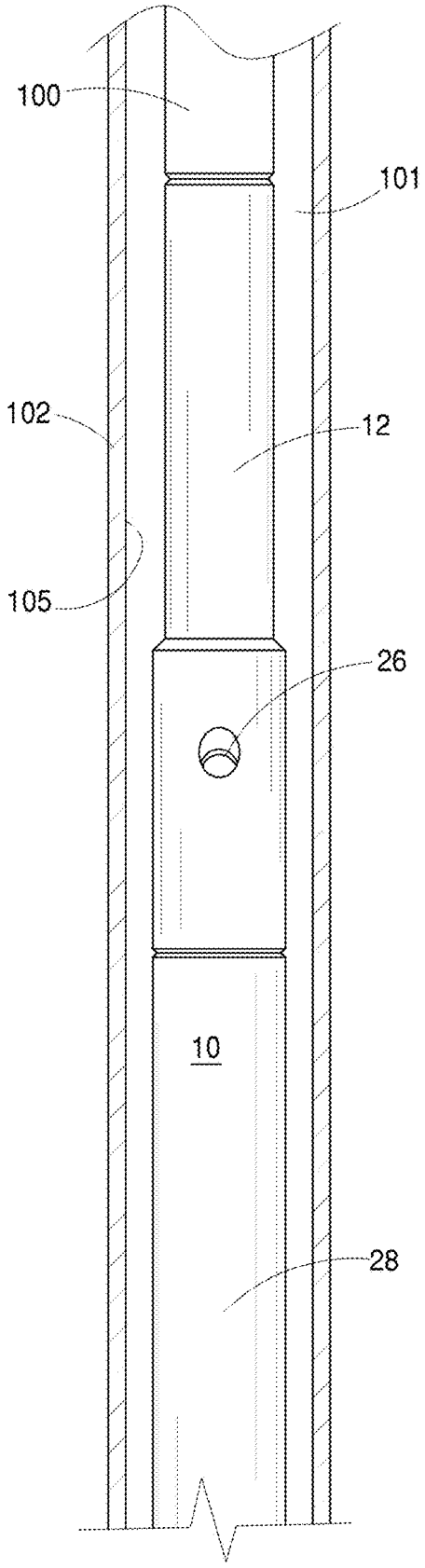
FIG. 9A is a partial longitudinal side view of the upper end of the section mill of FIG. 1 and the top sub attached to a tool carrier pipe string positioned in a casing of a wellbore.
Figure 9B:
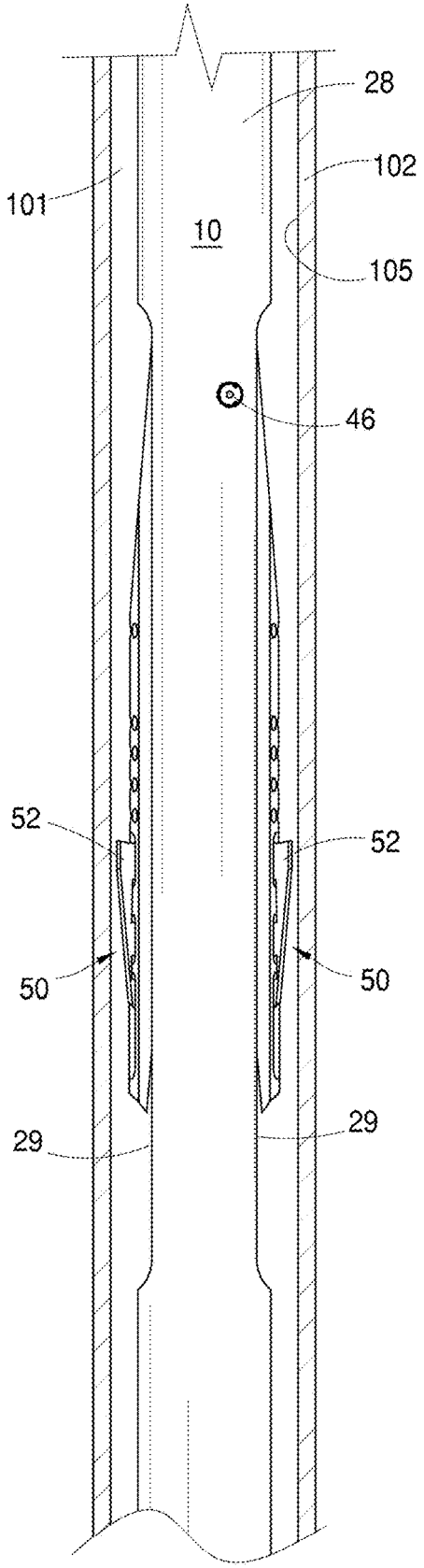
FIG. 9B is a partial longitudinal side view of the lower end of the section mill of FIG. 1 positioned in a casing of a wellbore.

For operation of the milling tool 10, the top sub 12 of the milling tool 10 is threadedly connected to the tubular mill body 28 of the milling tool 10 by top sub threaded connection 18 and tool body threaded connection 32. The upper end 11 of the top sub 12 is then connected to the tool carrier pipe string 100 threaded connection 16. The tool carrier pipe string 100 and the connected section mill 10 are then inserted through the central bore 101 of a wellbore tubular 102 such as a wellbore casing or another wellbore tubular to be milled and lowered to a desired downhole location in the wellbore tubular 102 as shown in FIGS. 9A and 9B.

When the section mill 10 is lowered into the wellbore tubular 102, the compression spring 38 maintains the translatable piston 34 and its elongated driveshaft 36 in an upward position with the hook 43 on the lower portion 39 of the elongated driveshaft 36 is mated with its corresponding hook catch 44 in the mill carrier 40. This engagement keeps the mill carrier 40 and the associated cutter blades 50 inside the mill body 28 to prevent interference with the wellbore tubular 102 during insertion of the mill tool 10.

Figure 7:
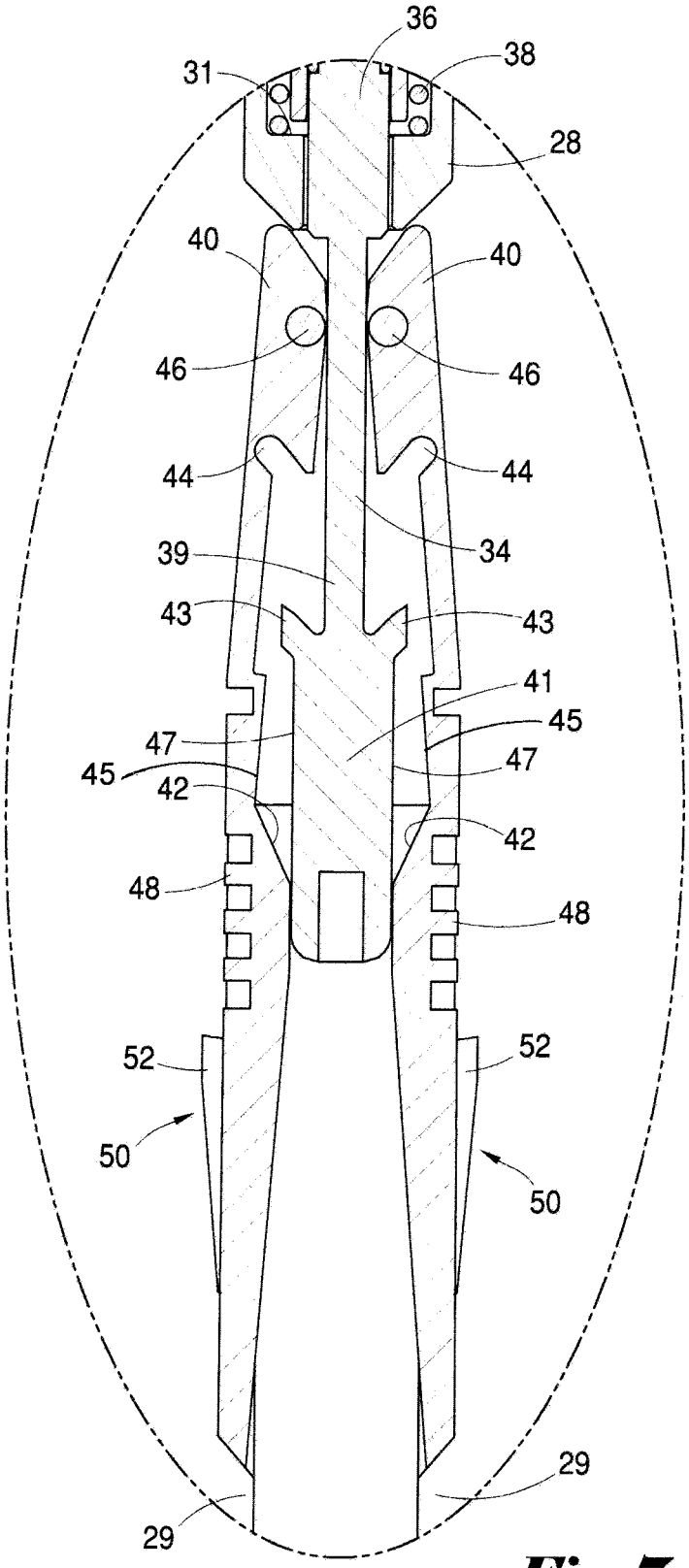
FIG. 7 is a detailed longitudinal cross-section side view of the area designed as Detail 7 shown in FIG. 5B.

Fluid is then pumped into the central fluid bore 104 of the tool carrier pipe string 100 and through the central fluid bore 14 of the top sub 12 to enter the central fluid bore 30 of the tubular mill body 28 of the section mill 10. The fluid in the central fluid bore 30 of the tubular mill body 28 generates fluid pressure on the translatable piston 34 and translates the normally upwardly biased translatable piston 34 downward in a downhole direction to compresses the compression spring 38. Compression of the compression spring 38 disengages the hook 43 from the hook catch 44 of the mill carrier 40 to allow further downward translation of the drive piston 34 and its elongated driveshaft 36. This downward movement will engage the periphery 47 of the nose cone 41 of the elongated driveshaft 36 with the beveled ramp profile 42 on the interior edge of the pivotally mounted mill carrier 40 to pivot the mill carrier 40 on hinge pin 46 with respect to the longitudinally extending mill body 28 and extend the mill carrier 40 and its associated cutter blade 50 radially outward at an acute angle from the mill body 28 through mill window 29 as shown in FIG. 7. The beveled ramp 42 maintains the mill carrier 40 radially outward at an acute angle during the milling process.

When extended through the mill window 29, the mill carrier 40 and cutter blade 50 will be positioned in the annulus 101 between the tubular mill body 28 of the section mill 10 and the interior wall 105 of the wellbore tubular 102. Further extension of the mill carrier 40 and its associated cutter blade 50 will force cutter surface 52 on the cutter blade 50 against the inner wall 105 of the wellbore tubular 102.

Milling is then conducted by rotating the tool carrier pipe string 100 and the attached section mill 10 to engage the cutter surface 52 of the cutter blade 50 with the inner wall 105 of the wellbore tubular 102. Once the nose cone 41 is fully translated on the beveled ramp profile 42 of the mill carriers 41, the mill carrier cannot close until the fluid pressure on the translatable piston 34 is relieved. Cuttings created during milling are carried away by fluid circulation through the central fluid bore 14 of the top sub 12 and the central fluid bore 30 of mill body 28, upward in the annulus 102 between the tubular mill body 28 and the wellbore tubular 102 being milled. If coiled tubing is used as the carrier pipe string 100, a downhole motor such as a mud motor will typically be used to rotate the attached section mill 10.

Once fluid pumping ceases, fluid pressure in the central fluid bore 14 is relieved to allow the compression spring 38 to extend and translate the translatable piston 34 and its elongated driveshaft 36 upward. The upward translation of the translatable piston 34 and its elongated driveshaft moves the periphery of the nose cone 41 upward along the beveled ramp profile 42 on the interior edge of pivotally mounted mill carrier 40 to pivot the mill carrier 40 on hinge pin 46 from its acute outward angle with respect to the longitudinally extending mill body 28 radially inward to retract the mill carrier 40 and its associated cutter blade 50 into the tubular mill body 28 through the mill window 29. This upward movement of the drive piston 34 and its elongated driveshaft 36 will re-engage the hook 43 on the driveshaft 36 with the hook catch 44 of the mill carrier 40 to hold the mill carrier 40 within the tool body 28 and allow the section mill 10 to be removed from the wellbore tubular 102.

Figure 10:
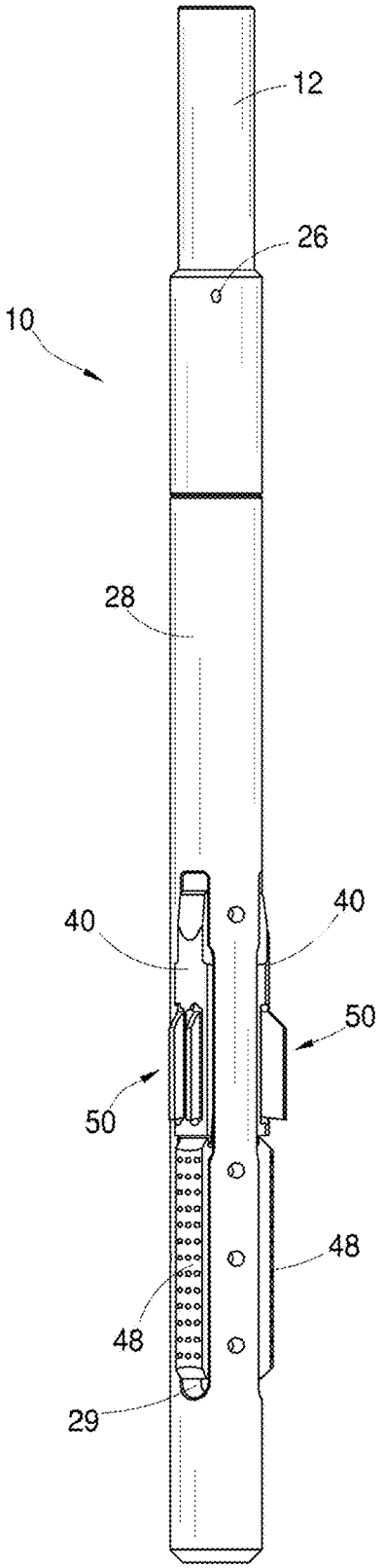
FIG. 10 is a longitudinal side view of an alternate embodiment of the proposed section mill.
Figure 11:
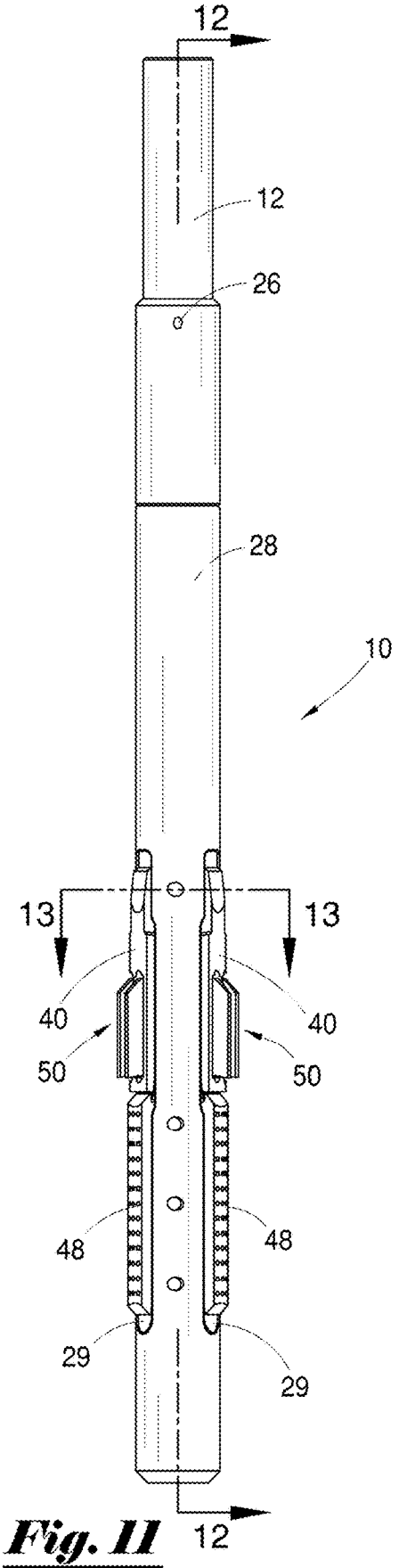
FIG. 11 is a longitudinal side view of the embodiment of the section mill shown in FIG. 10 rotated 60 degrees.
Figure 12A:
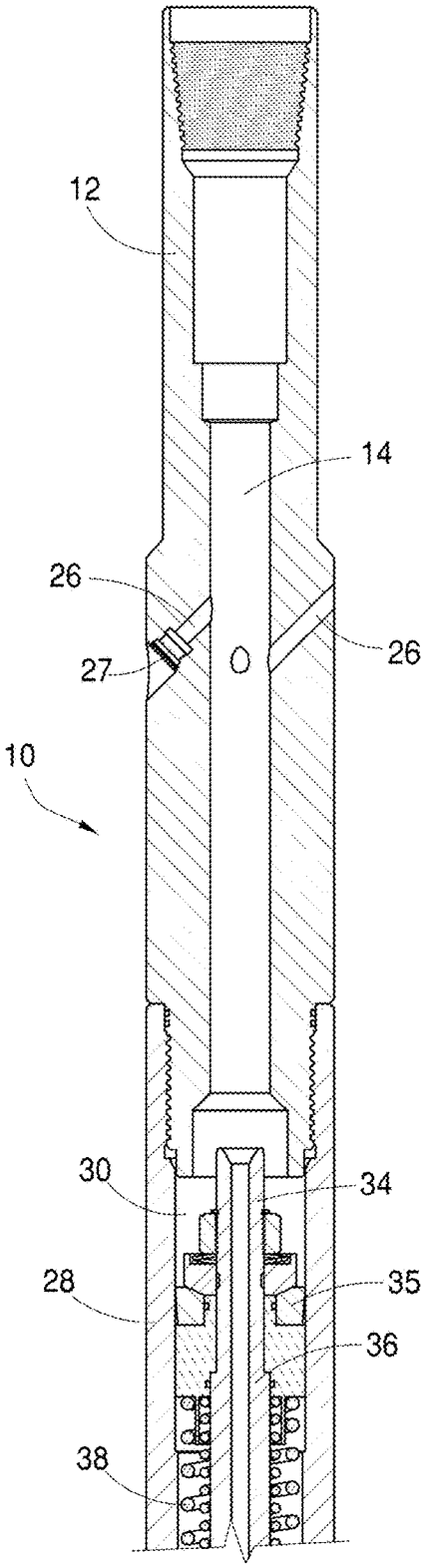
FIG. 12A is a partial longitudinal cross-section view of the upper end of the embodiment of the section mill shown in FIG. 10 cut along Section 12-12 of FIG. 11.
Figure 12B:
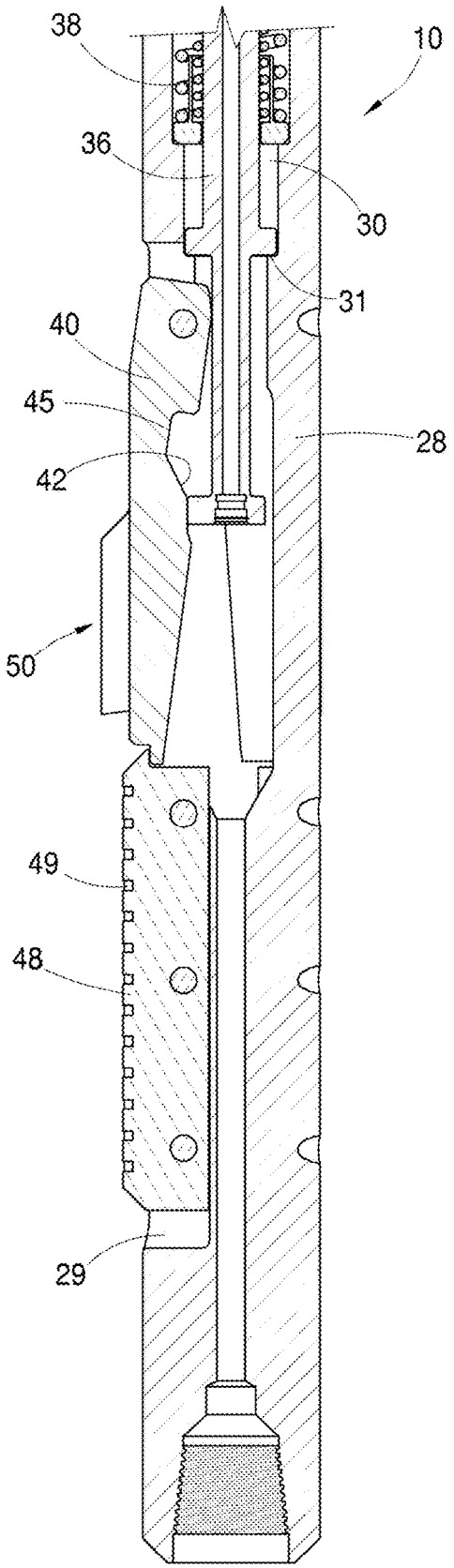
FIG. 12B is a partial longitudinal cross-section view of the lower end of the embodiment of the section mill shown in FIG. 10 cut along Section 12-12 of FIG. 11.

FIGS. 10-12 show an alternate embodiment of the proposed section mill 10 configured with three sets of cutter blades 50 arranged at 120 degree intervals around the tool body 28. Such an embodiment and cutter blade arrangement will be suitable for larger diameter casing tubulars 102. This embodiment utilizes the same extension and retraction mechanism for deployment of the cutters 50 as previously described.

FIG. 13 is a horizontal cross-section view of the alternate embodiment of the proposed section mill 10 shown in FIG. 10 that is cut along section 13-13 illustrating the 120 degree interval arrangement of the mill carriers 40. Each of the mill carriers 40 shown in FIG. 13 are pivotally mounted by a hinge pin 46 that is threadedly attached within a pin bore 57 in the mill body 28.

Detail 14 from FIG. 13 is shown in FIG. 14 and illustrates a hinge pin 46 threadedly positioned by pin threads 53 in place in a corresponding hinge pin bore 57 in the mill body 28. Each hinge pin 46 is secure in place in the hinge pin bore 57 by a spring retainer 51 positioned in the pin spring cavity 59 at the threaded end 61 of the hinge pin 46. The spring retainer 51 is held in place within the hinge pin bore 57 in an associated slot or groove 58 in the hinge pin bore 57. The spring retainer 51 assists in controlling unwanted rotation of the hinge pin 46 at the pin threads 53 and serves to keep the hinge pin 46 securely in place in its corresponding pivot bore 57 during milling operations.

Figure 15:
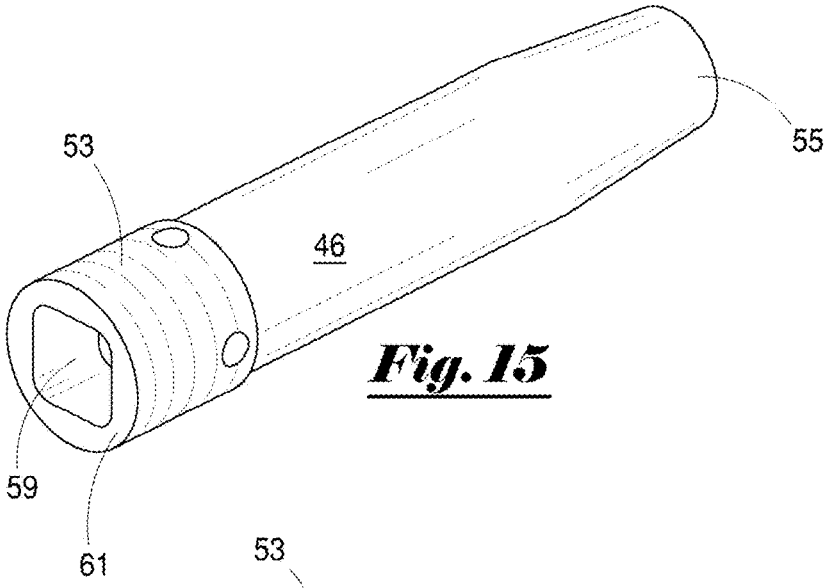
FIG. 15 is a perspective view of the mill carrier hinge pin.
Figure 16:
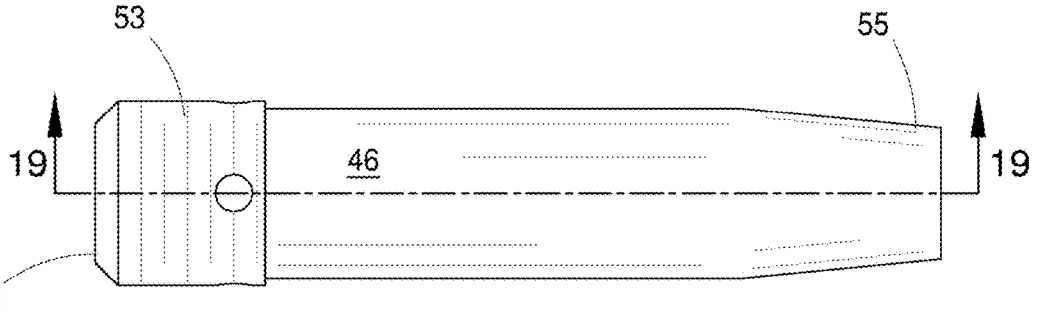
FIG. 16 is a side view of the mill carrier hinge pin shown in FIG. 15.
Figure 17:
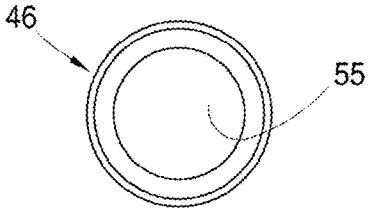
FIG. 17 is an insert-end view of the mill carrier hinge pin shown in FIG. 15.
Figure 18:
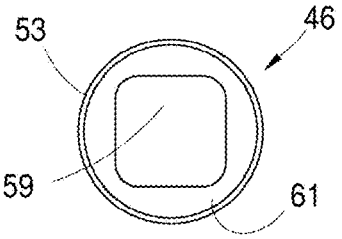
FIG. 18 is a thread-end view of the mill carrier hinge pin shown in FIG. 15.
Figure 19:
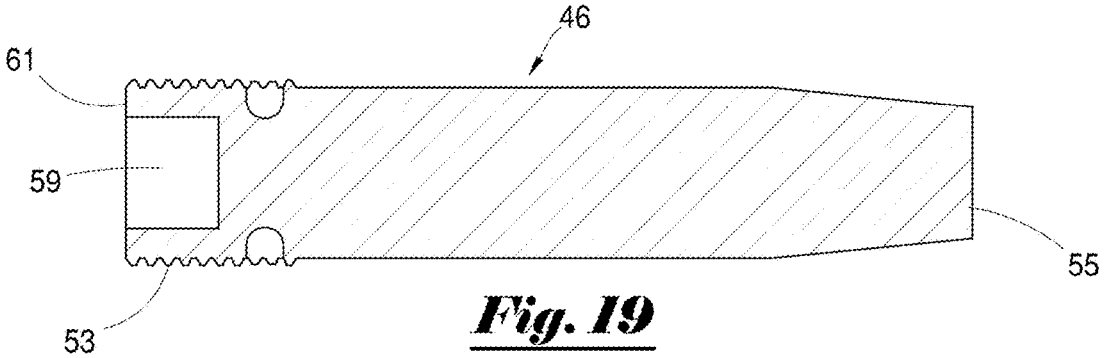
FIG. 19 is a longitudinal cross-section view of the mill carrier hinge pin shown in FIG. 15 cut along Section 19-19 shown in FIG. 16.

FIG. 15 shows a perspective view of the hinge pin 46 with its attachment threads 53, insert end 55, threaded end 61, and pin spring cavity 59. FIGS. 16-19 show detail views of the hinge pin 46.

It is thought that the embodiments of the section mill 10 presented herein and its attendant advantages will be understood from the foregoing description. It will be apparent that various changes may be made in the form, construction, and arrangement of the parts of the embodiments of the section mill 10 without departing from the spirit and scope of the invention or sacrificing its material advantages. The form and construction described and illustrated herein are merely example embodiments of the invention.

We claim:

1. A section mill comprising:

(a) a longitudinally extending tubular mill body, said longitudinally extending tubular mill body having a central fluid bore;

(b) a mill carrier pivotally mounted to said longitudinally extending tubular mill body by a hinge pin positioned transverse to said longitudinally extending tubular mill body whereby said mill carrier pivots on said hinge pin radially outward from said longitudinally extending tubular mill body at an acute longitudinal angle with respect to said longitudinally extending tubular mill body, said mill carrier having an exterior surface and an interior surface, said interior surface of said mill carrier having a beveled ramp profile;

(c) a translatable piston positioned within said central fluid bore of said longitudinally extending tubular mill body, said translatable piston having an elongated driveshaft having a radially extending nose cone engageable with said beveled ramp profile on said interior surface of said mill carrier; and (d) wherein said translatable piston is biased in an upward position.

2. The section mill recited in claim 1, wherein said mill is configured to pivot pivots radially outward and inward on said hinge pin in response to downward and upward movement of said nose cone along said beveled ramp profile on said interior surface of said mill carrier.

3. The section mill recited in claim 2, wherein said translatable piston is configured to move upward and downward in response to fluid pressure within said central fluid bore of said longitudinally extending tubular mill body.

4. The section mill recited in claim 3, further comprising a cutter blade on said exterior surface of said mill carrier, said cutter blade having a cutter surface.

5. The section mill recited in claim 4, further comprising a hook on said elongated drive shaft of said translatable piston, said hook configured to mate with a corresponding hook catch on said mill carrier.

6. The section mill recited in claim 5, whereby said hook on said elongated drive shaft of said translatable piston is configured to mate with said hook catch-on said mill carrier by said upward movement said translatable piston.

7. The section mill recited in claim 6, whereby said hook on said elongated driveshaft of said translatable piston is configured to disengage from said hook catch by said downward movement of said translatable piston.

8. The section mill recited in claim 7, wherein said translatable piston is biased in an upward position by a compression spring.

9. The section mill recited in claim 8, further comprising a mill window in said longitudinally extending tubular mill body, wherein said mill carrier is configured to pivot on said hinge pin radially outward at an acute angle from said longitudinally extending tubular mill body through said mill window.

10. A section mill comprising:

(a) a longitudinally extending tubular mill body having an upper end, a lower end, a mill body central fluid bore, and a mill window;

(b) a mill carrier positioned within said longitudinally extending tubular mill body, said mill carrier having an exterior surface and an interior surface, said interior surface of said mill carrier having a beveled ramp profile;

(c) a cutter blade on said exterior surface of said mill carrier, said cutter blade having a cutter surface;

(d) a hinge pin transversely mounted to said longitudinally extending tubular mill body, said hinge pin pivotally mounting said mill carrier to said longitudinally extending tubular mill body within said central bore of said longitudinally extending tubular mill body whereby said mill carrier is configured to pivot longitudinally radially outward and inward with respect to said longitudinally extending tubular mill body;

(e) a translatable piston having an elongated driveshaft, said elongated driveshaft having an upper portion and a lower portion, said lower portion of said elongated driveshaft having a radially extending cylindrical nose cone, whereby said cylindrical nose cone is engageable with said beveled ramp profile of said interior surface of said mill carrier by downward translation of said translatable piston and disengageable from said beveled ramp profile of said interior surface of said mill carrier by upward translation of said translatable piston; and (f) wherein said translatable piston is biased in an upward position by a compression spring.

11. The section mill recited in claim 10, whereby said translatable piston is configured to pivot said mill carrier longitudinally radially outward at an acute angle through said mill window in response to said downward translation and whereby said translatable piston is configured to pivot said mill carrier longitudinally radially inward through said mill window in response to said upward translation.

12. The section mill recited in claim 11, wherein said translatable piston is configured to translate upward and downward within said central bore of said longitudinally extending tubular mill body in response to fluid pressure in said central fluid bore of said mill body.

13. The section mill recited in claim 12, further comprising:

(a) a hook on said translatable piston, said hook configured to engage with a corresponding hook catch in said mill carrier by said upward translation of said translatable piston and disengaged from said hook catch by said downward translation of said translatable piston.

14. The section mill recited in claim 13, further comprising:

(a) attachment threads on a threaded end of said transversely mounted hinge pin, said threaded end of said transversely mounted hinge pin having a spring cavity;

(b) a hinge pin bore in said longitudinally extending tubular mill body wherein said threaded end of said transversely mounted hinge pin is threadedly positioned; and (c) a spring retainer positioned in said spring cavity securing said hinge pin in said hinge pin bore.

15. The section mill recited in claim 13, further comprising:

(a) a tool carrier pipe string having a tool carrier pipe string central fluid bore;

(b) a top sub having a top sub central fluid bore; and (c) wherein said mill body central fluid bore, said top sub central fluid bore, and said tool carrier pipe string central fluid bore are in fluid communication.

16. A section mill assembly comprising:

(a) a tool carrier pipe string having a tool carrier pipe string central fluid bore;

(b) a top sub having a top sub central fluid bore in fluid communication with said tool carrier pipe string central fluid bore;

(c) a section mill comprising (i) a longitudinally extending tubular mill body, said longitudinally extending tubular mill body having an upper end, a lower end, a mill body central fluid bore, and a mill window, said upper end of said longitudinally extending tubular mill body attached to said top sub with said mill body central fluid bore in fluid communication with said top sub central fluid bore;

(ii) a mill carrier positioned within said longitudinally extending tubular mill body, said mill carrier having an exterior surface and an interior surface, said interior surface of said mill carrier having a beveled ramp profile;

(iii) a hinge pin transversely mounted to said longitudinally extending tubular mill body, said hinge pin pivotally mounting said mill carrier to said longitudinally extending tubular mill body within said central bore of said longitudinally extending tubular mill body whereby said mill carrier is configured to pivot longitudinally radially outward and inward through said mill window with respect to said longitudinally extending tubular mill body;

(iv) a translatable piston having an elongated driveshaft, said elongated driveshaft having an upper portion and a lower portion, said lower portion of said elongated driveshaft having a cylindrical nose cone extending radially from said elongated driveshaft, whereby said cylindrical nose cone is engageable with said beveled ramp profile of said interior surface of said mill carrier by downward translation of said translatable piston and disengageable from said beveled ramp profile of said interior surface of said mill carrier by upward translation of said translatable piston;

(v) a compression spring positioned around said elongated driveshaft, said compression spring extending between said translatable piston and an interior shoulder on said tubular mill body, said translatable piston biased in an upward position by said compression spring; and (vi) wherein said mill carrier is configured to pivot on said hinge pin radially outward from said mill window at an acute angle and inward from said acute angle through said mill window in response to engagement of said nose cone with said beveled ramp profile of said mill carrier by said downward and said upward translation of said translatable piston.

17. The section mill assembly recited in claim 16, wherein said section mill is further comprised of:

(a) a hook on said cylindrical nose cone of said translatable piston;

(b) a corresponding hook catch on said mill carrier; and (c) wherein said hook is configured to engage with said corresponding hook catch on said mill carrier by said upward translation of said translatable piston and disengage from said hook catch by said downward translation of said translatable piston.

18. The section mill assembly recited in claim 17, wherein said section mill is further comprised of:

(a) attachment threads on a threaded end of said transversely mounted hinge pin, said threaded end of said transversely mounted hinge pin having a spring cavity;

(b) a hinge pin bore in said longitudinally extending tubular mill body wherein said threaded end of said transversely mounted hinge pin is threadedly positioned; and (c) a spring retainer positioned in said spring cavity securing said hinge pin in said hinge pin bore.

* * * * *